US007814876B2

(12) United States Patent
Nakawatase

(10) Patent No.: US 7,814,876 B2
(45) Date of Patent: Oct. 19, 2010

(54) INTAKE AIRFLOW CONTROL MECHANISM FOR ENGINE

(75) Inventor: Akira Nakawatase, Toyota (JP)

(73) Assignee: Toyota Jidosha Kabushiki Kaisha, Toyota-Shi (JP)

( * ) Notice: Subject to any disclaimer, the term of this patent is extended or adjusted under 35 U.S.C. 154(b) by 40 days.

(21) Appl. No.: 12/413,781

(22) Filed: Mar. 30, 2009

(65) Prior Publication Data

US 2009/0241889 A1 Oct. 1, 2009

(30) Foreign Application Priority Data

Mar. 28, 2008 (JP) ..... 2008-086256

(51) Int. Cl.
*F02B 31/00* (2006.01)

(52) U.S. Cl. ..... 123/184.21

(58) Field of Classification Search ..... 123/184.21–184.61

See application file for complete search history.

(56) References Cited

U.S. PATENT DOCUMENTS

| | | | | | |
|---|---|---|---|---|---|
| 4,803,961 | A | * | 2/1989 | Hiraoka et al. | 123/184.36 |
| 4,875,438 | A | * | 10/1989 | Suzuki et al. | 123/184.55 |
| 4,972,814 | A | * | 11/1990 | Matsuki et al. | 123/308 |

FOREIGN PATENT DOCUMENTS

| | | | |
|---|---|---|---|
| JP | 62223440 | | 10/1987 |
| JP | 02070918 | | 3/1990 |
| JP | 03121250 | | 5/1991 |
| JP | 07158479 | | 6/1995 |
| JP | 11190218 | A | 7/1999 |
| JP | 2000073843 | A | 3/2000 |
| JP | 2002295271 | | 8/2002 |
| JP | 2004293476 | | 10/2004 |
| JP | 2006029526 | | 2/2006 |
| JP | 2006090335 | | 4/2006 |
| JP | 2006266092 | | 10/2006 |
| JP | 2007068378 | | 3/2007 |

* cited by examiner

*Primary Examiner*—M. McMahon
(74) *Attorney, Agent, or Firm*—Gifford, Krass, Sprinkle, Anderson & Citkowski, P.C.

(57) ABSTRACT

An intake airflow control mechanism for an engine includes a first valve shaft on which valve elements of intake airflow control valves are fitted in such a manner that the valve elements pivot in accordance with the rotation of the first valve shaft; a second valve shaft on which valve elements of intake airflow control valves are fitted in such a manner that the valve elements pivot in accordance with the rotation of the second valve shaft; an actuator that rotates the first valve shaft, a link mechanism that transmits the rotation of the first valve shaft to the second valve shaft, a stopper that stops the rotation of the second valve shaft when the second valve shaft is in a prescribed rotational position, and a sensor that detects the amount by which the first valve shaft is rotated by the actuator.

10 Claims, 3 Drawing Sheets

INTAKE AIRFLOW CONTROL MECHANISM FOR ENGINE

INCORPORATION BY REFERENCE

The disclosure of Japanese Patent Application No. 2008-086256 filed on Mar. 28, 2008 including the specification, drawings and abstract is incorporated herein by reference in its entirety.

BACKGROUND OF THE INVENTION

1. Field of the Invention

The invention relates to an intake airflow control mechanism for an engine, which includes a first valve shaft on which valve elements of intake airflow control valves are fitted in such a manner that the valve elements pivot in accordance with the rotation of the first valve shaft, a second valve shaft on which valve elements of intake airflow control valves are fitted in such a manner that the valve elements pivot in accordance with the rotation of the second valve shaft, an actuator that rotates the first valve shaft, and a link mechanism that transmits the rotation of the first valve shaft to the second valve shaft.

2. Description of the Related Art

Many types of engines such as cylinder-injection engines are provided with intake airflow control mechanisms that control intake airflows in cylinders such as swirl flows and tumble flows. The intake airflow control mechanism includes intake airflow control valves that are provided at intake ports of the engine, and opens and closes the intake airflow control valves to partially open and close the intake ports, thereby changing the manner of formation of the intake airflows in the cylinders.

FIG. 6 shows an example of an existing intake airflow control mechanism mounted in a V-engine. As shown in FIG. 6, the intake airflow control mechanism includes an actuator 50 that opens and closes an intake airflow control valves. Valve elements 53 of intake airflow control valves, which are provided at intake ports 52 for cylinders in one of the right and left banks of the V-engine (first bank), are fixed to a first valve shaft 51 in such a manner that the valve elements 53 pivot in accordance with the rotation of the first valve shaft 51. The base end of the first valve shaft 51 is connected to the actuator 50. The tip end of the first valve shaft 51 is connected to the base end of a second valve shaft 55 via a link mechanism 54, and the rotation of the first valve shaft 51 is transmitted to the second valve shaft 55 via the link mechanism 54. Valve elements 57 of intake airflow control valves, which are provided at intake ports 56 of cylinders in the other of the right and left banks (second bank), are fixed to the second valve shaft 55 in such a manner that the valve elements 57 pivot in accordance with the rotation of the second valve shaft 55

In the intake airflow control mechanism for a V-engine, when the actuator 50 rotates the first valve shaft 51, the rotation of the first valve shaft 51 is transmitted via the link mechanism 54 so that the second valve shaft 55 is rotated in accordance with the rotation of the first valve shaft 51. Therefore, even in a V-engine in which the valve elements 53 of the intake airflow control valves are provided at one of the right and left banks and the valve elements 57 of the intake airflow control valves are provided at the other bank, all the valve elements 53 and 57 are opened and closed with the use of only the single actuator 50. With the structure in which the first valve shaft 51 provided at one of the banks and the second valve shaft 52 provided at the other bank are connected to each other via the link mechanism 54, it is no longer necessary to provide actuators for the respective banks. As a result, the structure of the intake airflow control mechanism is simplified.

Japanese Patent Application Publication No. 2002-295271 describes a throttle mechanism for a V-engine, which is similar in structure to the intake airflow control mechanism for a V-engine described above. In the throttle mechanism, throttle valves are provided at intake ports of respective cylinders of a V-engine. Valve elements of the throttle valves provided at the banks are fitted on a first valve shaft and a second valve shaft in such a manner that the valve elements pivot in accordance with the rotation of the throttle valves. The first valve shaft and the second valve shaft are connected to each other via a link mechanism so that the first valve shaft and the second valve shaft rotate together with each other. Therefore, all the throttle valves, some of which are provided at the right bank and the other of which are provided at the left bank in the V-engine, are collectively opened and closed by a single actuator.

The above-described intake airflow control mechanisms for a V-engine are each provided with a sensor that monitors the operating state of the intake airflow control mechanism to determine whether a malfunction has occurred. Malfunctions that need to be detected include locking of a movable portion of the actuator 50, locking of the valve elements 53 and 57, and breakage of portions at which the operating members are connected to each other. In order to detect interruption of the driving linkage between the actuator 50 and the second valve shaft 55 due to, for example, breakage of a portion at which the link mechanism 54 and the second valve shaft 55 are connected to each other, the operating state of the second valve shaft 55 needs to be directly monitored. Therefore, the installation position of the sensor is limited. That is, a malfunction detection sensor 58 needs to be provided near the second valve shaft 55, as shown in FIG. 6. Accordingly, the actuator 50 and the sensor 58, which constitute an electric system of the intake airflow control mechanism, need to be provided at different locations. This increases the installation space, and makes it difficult to install the mechanism. If the workability during installation of the mechanism is taken into account, the actuator 50 and the sensor 58 are preferably integrated with each other. However, because the actuator 50 and the sensor 58 need to be installed at different locations, the structure in which the actuator 50 and the sensor 58 are integrated with each other cannot be employed.

SUMMARY OF THE INVENTION

The invention provides an intake airflow control mechanism for an engine that makes it possible to accurately determine whether a malfunction has occurred and to provide elements at appropriate locations.

An aspect of the invention relates to an intake airflow control mechanism for an engine. The intake airflow control mechanism includes: a first valve shaft on which a valve element of an intake airflow control valve is fitted in such a manner that the valve element pivots in accordance with rotation of the first valve shaft; a second valve shaft on which a valve element of an intake airflow control valve is fitted in such a manner that the valve element pivots in accordance with rotation of the second valve shaft; an actuator that rotates the first valve shaft; a link mechanism that transmits the rotation of the first valve shaft to the second valve shaft; a stopper that stops the rotation of the second valve shaft when the second valve shaft is in a prescribed rotational position; and a sensor that detects an amount by which the first valve shaft is rotated by the actuator.

With the structure described above, when the first valve shaft is rotated by the actuator, the link mechanism causes the second valve shaft to rotate in accordance with the rotation of the first valve shaft. Thus, the valve elements fitted on the first valve shaft and the second valve shaft are collectively opened and closed. The amount by which the first valve shaft is rotated by the actuator is detected by the sensor.

With the structure described above, the rotation of the second valve shaft is stopped when the second valve shaft is in the prescribed rotational position. When the rotation of the second valve shaft is stopped by the stopper, the rotation of the first valve shaft, which is caused by the actuator, is also stopped. If the driving linkage between the actuator and the second valve shaft is properly maintained, the rotation of the first valve shaft is stopped when the amount by which the first valve shaft is rotated by the actuator reaches the rotation amount that is required to rotate the second valve shaft to the rotational position in which the second valve shaft is stopped by the stopper. On the other hand, if the driving linkage between the actuator and the second valve shaft is interrupted, the rotation of the first valve shaft caused by the actuator is not stopped. Therefore, if the above-described stopper is provided, it is possible to determine whether the driving linkage between the actuator and the second valve shaft is interrupted, by just checking the amount by which the first valve shaft is rotated by the actuator without directly monitoring the operating state of the second valve shaft. Therefore, it is possible to determine whether a malfunction has occurred in the intake airflow control mechanism without the need for providing the sensor at a position distant from the actuator. Therefore, with the structure described above, it is possible to accurately determine whether a malfunction has occurred and to provide the actuator and the sensor at appropriate locations.

In the aspect of the invention described above, the sensor may be embedded in the actuator. If the above-described stopper is provided, the sensor for detecting a malfunction may be configured to detect the amount by which the first valve shaft is rotated by the actuator. The sensor of this type may be embedded in the actuator. If the sensor is embedded in the actuator, the sensor is installed more easily.

In the aspect of the invention described above, the stopper may stop the rotation of the second valve shaft when the second valve shaft is in a rotational position in which the valve element fitted on the second valve shaft is either fully opened or fully closed.

The rotational position, in which the second valve shaft is stopped by the stopper, may be set to any position outside the range of rotation of the second valve shaft, which is required to execute the intake airflow control. However, if the rotational position in which the valve element is fully opened and the rotational position in which the valve element is fully closed are both used as the rotational positions in which the second valve shaft is stopped by the stopper, it is possible to ensure the opportunity to detect a malfunction and to minimize unnecessary operation of the actuator to detect a malfunction.

In the aspect of the invention described above, the stopper may be provided at an end of the second valve shaft, the end being on the opposite side of an end of the second valve shaft to which the link mechanism is connected.

If the stopper is provided at the end of the second valve shaft, the end being on the opposite side of the end of the second valve shaft to which the link mechanism is connected as described above, even when the second valve shaft brakes at its middle portion, it is possible to detect the breakage. This structure is particularly effective when the second valve shaft is formed of multiple members instead of a single member.

The intake airflow control mechanism according to the aspect of the invention described above may further include a malfunction detection unit that determines that a malfunction has occurred, when the first valve shaft is continuously rotated by the actuator even after the amount by which the first valve shaft is rotated by the actuator, the amount being detected by the sensor, exceeds an amount of rotation that is required to rotate the second valve shaft to the rotational position in which the rotation of the second valve shaft is stopped by the stopper.

If the malfunction detection unit structured as described above is provided in the intake airflow control mechanism that includes the stopper and sensor, it is possible to accurately detect a malfunction due to interruption of driving linkage between the actuator and the second valve shaft.

In the aspect of the invention described above, the sensor may be a hall element sensor that detects the amount of rotation with the use of a hall element.

The hall element sensor may be used as the sensor for detecting a malfunction, which is provided in the intake airflow control mechanism for an engine according to the aspect of the invention. In the aspect of the invention described above, the intake airflow control mechanism may be provided in a V-engine, the first valve shaft may be provided at one of banks of the V-engine, and the second valve shaft may be provided at the other bank of the V-engine.

In a V-engine some cylinders are formed in one of the right and left banks and the other cylinders are formed in the other bank. Therefore, valve shafts for intake airflow control valves needs to be provided at the respective banks. According to the aspect of the invention described above, even in the intake airflow control mechanism that is employed in the V-engine, it is possible to accurately detect a malfunction with the use of only the sensor provided near the actuator.

BRIEF DESCRIPTION OF THE DRAWINGS

The foregoing and further features and advantages of the invention will become apparent from the following description of an example embodiment with reference to the accompanying drawings, wherein the same or corresponding portions are used to represent like elements and wherein.

DETAILED DESCRIPTION OF THE EXAMPLE EMBODIMENT

Hereafter, an intake airflow control mechanism for an engine according to an embodiment of the invention will be described with reference to FIGS. 1 and 2. The intake airflow control mechanism according to the embodiment of the invention is applied to a V-six engine.

Figure 1:
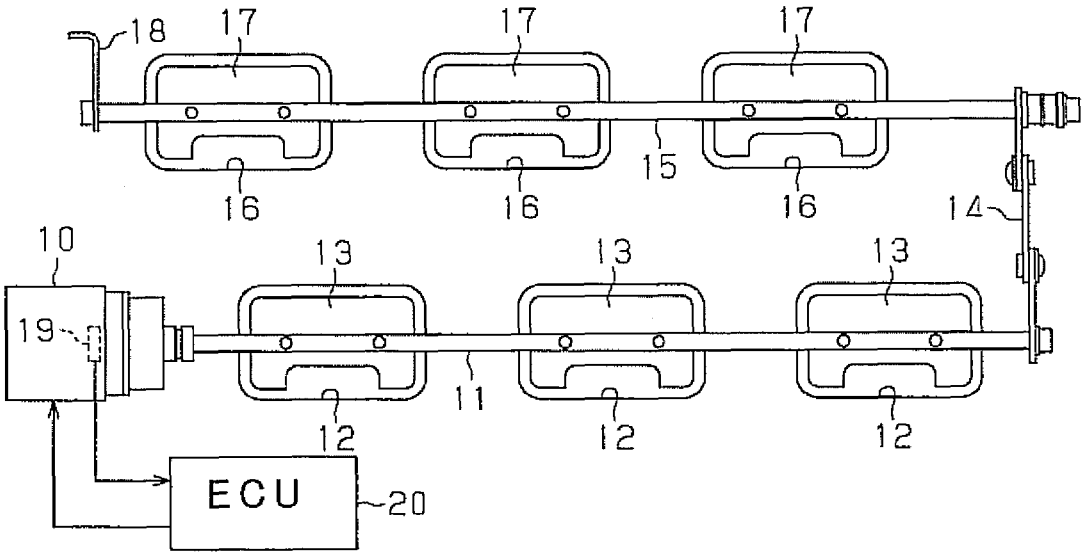
FIG. 1 is a view schematically showing the overall structure of an intake airflow control mechanism for an engine according to an embodiment of the invention.

FIG. 1 shows the overall structure of the intake airflow control mechanism for an engine according to the embodiment of the invention. As shown in FIG. 1, the intake airflow control mechanism includes an actuator 10 that opens and closes intake airflow control valves. The base end of a first valve shaft it is connected to the actuator 10, and the first valve shaft 11 is rotated directly by the actuator 10. Valve elements 13 of the intake airflow control valves provided at intake ports 12 for respective cylinders in one of the right and left banks (first bank) of the V-engine are fixed on the first valve shaft 11 in such a manner that the valve elements 13 pivot in accordance with the rotation of the first valve shaft 11. The tip end of the first valve shaft 11 is connected to the base end of a second valve shaft 15 via a link mechanism 14 that transmits the rotation of the first valve shaft 11. Valve elements 17 of the intake airflow control valves provided at intake ports 16 for respective cylinders in the other of the right and left banks (second bank) are fixed on the second valve shaft 15 in such a manner that the valve elements 17 pivot in accordance with the rotation of the second valve shaft 15.

In the thus structured intake airflow control mechanism, when the first valve shaft 11 is rotated by the actuator 10, the link mechanism 14 causes the second valve shaft 15 to rotate in accordance with the rotation of the first valve shaft 11. Thus, the valve elements 13 and 17 of the intake airflow control valves for all the cylinders of the V-engine are collectively opened and closed by the actuator 10.

In the intake airflow control mechanism for an engine according to the embodiment of the invention, a stopper 18 is provided at the tip end of the second valve shaft 15, that is, the end of the second valve shaft 15, the end being on the opposite side of the end connected to the link mechanism 14. The stopper 18 stops the rotation of the second valve shaft 15 when the second valve shaft 15 is in a rotational position in which the valve elements 17 fitted on the second valve shaft 15 are either fully opened or fully closed. That is, the stopper 18 limits the range, in which the second valve shaft 15 is allowed to rotate, to a range from the rotational position in which the valve elements 17 are fully closed to the rotational position in which the valve elements 17 are fully opened. If the driving linkage between the first valve shaft 11 and the second valve shaft 15 via the link mechanism 14 is properly maintained, the rotation of the first valve shaft 11 is stopped when the rotation of the second valve shaft 15 is stopped by the stopper 18.

In the intake airflow control mechanism for an engine according to the embodiment of the invention, a sensor 19, which detects the amount by which the first valve shaft 11 is rotated by the actuator 10, is embedded in the actuator 10.

In the embodiment of the invention, an electronic control unit 20 (hereinafter, referred to as "ECU 20") controls the actuator 10 that opens and closes the intake airflow control valves. The ECU 20 includes a central processing unit (CPU) that executes computation related to the control over the actuator 10, a read only memory (ROM) that stores control programs and data, a random access memory (RAM) that temporarily stores, for example, the results of computation executed by the CPU, and an input port and an output port that are used to exchange signals with external elements. A signal indicating the detection result obtained by the sensor 19 is input in the input port of the ECU 20.

Figure 2:
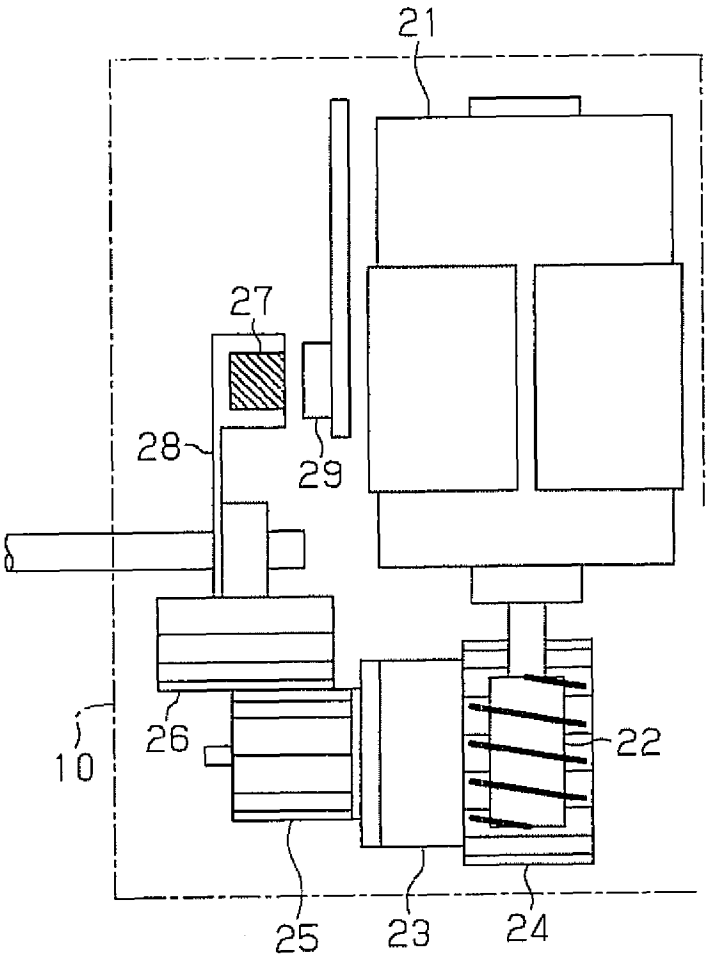
FIG. 2 is a view schematically showing the inner structure of an actuator of the intake airflow control mechanism according to the embodiment of the invention.

FIG. 2 shows the inner structure of the actuator 10 in which the sensor 19 is embedded. As shown in FIG. 2, the actuator 10 includes a motor 21. A worm gear 22, which is fixed to an output shaft of the motor 21, is meshed with a worm wheel 24 of a reduction gear unit 23. The reduction gear unit 23 includes an output gear 25 that may rotate together with the worm wheel 24. The output gear 25 is meshed with an input gear 26 that is fixed to the base end of the first valve shaft 11 in such a manner that the input gear 26 may rotate together with the first valve shaft 11. The rotation generated by the motor 21 is slowed while being transmitted via the worm gear 22, the reduction gear unit 23, and the input gear 26, and then transmitted to the first valve shaft 11.

In the actuator 10, a holding lever 28 that holds a magnet 27 at its tip end is fixed to the base end of the first valve shaft 11. The holding lever 28 pivots about its pivot axis in accordance with the rotation of the first valve shaft 11. A hall element 29, which generates a voltage corresponding to the magnetic field around the magnet 27 (hall voltage) under the hall effect, is fixedly provided in the actuator 10 in such a manner that the hall element 29 faces the magnet 27 held by the holding lever 28. A hall element sensor that includes the magnet 27 and the hall element 29 is used as the above-described sensor 19. That is, when the magnet 27 is moved by the pivot motion of the holding lever 28 that is caused by the rotation of the first valve shaft 11, the magnetic field that exerts an influence on the hall element 29 changes and the hall voltage that is generated by the hall element 29 changes. The sensor 19 detects the amount by which the first valve shaft 11 is rotated by the actuator 10 based on a change in the hall voltage.

Next, description will be provided concerning the manner in which the ECU 20 detects a malfunction that occurs in the intake airflow control mechanism for an engine according to the embodiment of the invention described above. In the embodiment of the invention, the ECU 20 detects the following six types of malfunctions: 1) breakage of a portion at which the actuator 10 and the first valve shaft 11 are connected to each other; 2) breakage of a portion at which the first valve shaft 11 and the link mechanism 14 are connected to each other and breakage of a portion at which the second valve shaft 15 and the link mechanism 14 are connected to each other; 3) breakage of a portion at which the second valve shaft 15 and the stopper 18 are connected to each other; 4) breakage of the gears in the actuator 10 (worm gear 22, reduction gear unit 23, input gear 26); 5) locking of the gears in the actuator 10 (worm gear 22, reduction gear unit 23, input gear 26) and locking of the motor 21; and 6) locking of the valve elements 13 and locking of the valve elements 17.

If at least one of the above-mentioned malfunctions 1) to 6) has occurred, the driving linkage between the actuator 10 and the stopper 18 is interrupted. Therefore, even if the first valve shaft 11 is rotated by the actuator 10, the stopper 18 does not pivot. Accordingly, in this case, even if the first valve shaft 11 is rotated by a large amount by the actuator 10, the stopper 18 does not stop the rotation of the first valve shaft 11. Accordingly, it is determined that at least one of the malfunctions 1) to 4) has occurred when the first valve shaft 11 is continuously rotated by the actuator 10 even after the amount by which the first valve shaft 11 is rotated by the actuator 10, the amount being detected by the sensor 19, exceeds the amount of rotation that is required to rotate the second valve shaft 15 to the rotational position in which the rotation of the second valve shaft 15 is stopped by the stopper 18. Therefore, the ECU 20 determines that at least one of the above-described malfunctions 1) to 4) has occurred when it is determined that the opening amount of the valve elements 13 and 17, which is estimated based on the rotation amount detected by the sensor 19, falls below the opening amount of the fully closed valve elements 13 and 17 or exceeds the opening amount of fully opened valve elements 13 and 17.

If at least one of the above-described malfunctions 5) and 6) has occurred, the rotation of the first valve shaft 11, which is caused by the actuator 10, is stopped at a certain rotational position. That is, in this case, even if the motor 21 is driven to achieve the desired opening amount of the valve elements 13 and 17, the valve elements 13 and 17 are stopped at the position at which the opening amount differs from the desired opening amount. Therefore, the ECU 20 determines that at least one of the malfunctions 5) and 6) has occurred when the duration of time that the opening amount of the valve elements 13 and 17 detected by the sensor 19 continuously deviates from the desired opening amount exceeds the estimated time period to achieve the desired opening amount.

In the intake airflow control mechanism for an engine according to the embodiment of the invention, the ECU 20 corresponds to a malfunction detection unit according to the invention. With the intake airflow control mechanism for an engine according to the embodiment of the invention described above) the following effects 1) to 7) are produced.

1) The intake airflow control mechanism for an engine according to the embodiment of the invention includes the stopper 18 that stops the second valve shaft 15 when the second valve shaft 15 is in a prescribed rotational position and the sensor 19 that detects the amount by which the first valve shaft 11 is rotated by the actuator 10. With this structure, if the driving linkage between the actuator 10 and the second valve shaft 15 is properly maintained, the rotation of the first valve shaft 11 is stopped when the amount by which the first valve shaft 11 is rotated by the actuator 10 reaches the rotation amount that is required to rotate the second valve shaft 15 to the rotational position in which the second valve shaft 15 is stopped by the stopper 18. On the other hand, if the driving linkage between the actuator 10 and the second valve shaft 15 is interrupted, the rotation of the first valve shaft 11 caused by the actuator 10 is not stopped. Therefore, if the above-described stopper 18 is provided, it is possible to determine whether the driving linkage between the actuator 10 and the second valve shaft 15 is interrupted, by just checking the amount by which the first valve shaft 11 is rotated by the actuator 10 without directly monitoring the operating state of the second valve shaft 15. Therefore, it is possible to determine whether a malfunction has occurred in the intake airflow control mechanism without the need for providing the sensor 19 at a position distant from the actuator 10. Therefore, according to the embodiment of the invention, it is possible to accurately determine whether a malfunction has occurred and to provide the actuator 10 and the sensor 19 at appropriate locations.

2) According to the embodiment of the invention, the sensor 19 that detects the amount by which the first valve shaft 11 is rotated by the actuator 10 is embedded in the actuator 10. As described above, if the above-described stopper 18 is provided, the sensor 19 for detecting a malfunction may be configured to detect the amount by which the first valve shaft 11 is rotated by the actuator 10. The sensor 19 of this type may be embedded in the actuator 10. If the sensor 19 is embedded in the actuator 10, the sensor 19 is installed more easily. That is, if the sensor 19 is embedded in the actuator 10, the actuator 10 and the sensor 19 may be fitted to the engine as a single assembly. Therefore, it is no longer necessary to fit the actuator 10 and the sensor 19 to the engine individually.

3) According to the embodiment of the invention, the stopper 18 is provided to stop the rotation of the second valve shaft 15 when the second valve shaft 15 is in the rotational position in which the valve elements 17 are fully opened or fully closed. It is possible to detect a malfunction due to interruption of driving linkage between the actuator 10 and the stopper 18, if the rotational position, in which the second valve shaft 15 is stopped by the stopper 18, is outside the range of rotation of the second valve shaft 15, which is required to execute the intake airflow control. However, if the rotational position in which the valve elements 17 are fully opened and the rotational position in which the valve elements 17 are fully closed are both used as the rotational positions in which the second valve shaft 15 is stopped by the stopper 18, it is possible to ensure the opportunity to detect a malfunction and to minimize unnecessary operation of the actuator to detect a malfunction.

4) According to the embodiment of the invention, the stopper 18 is provided at the end of the second valve shaft 15, the end being on the opposite side of the end of the second valve shaft 15, to which the link mechanism 14 is connected. Providing the stopper 18 in this manner makes it possible to detect breakage of the second valve shaft 15.

5) According to the embodiment of the invention, the ECU 20 determines that at least one of the above-described malfunctions 1) to 4) has occurred when the first valve shaft 11 is continuously rotated by the actuator 10 even after the amount by which the first valve shaft 11 is rotated by the actuator 10, the amount being detected by the sensor 19, exceeds the amount of rotation that is required to rotate the second valve shaft 15 to the rotational position in which the rotation of the second valve shaft 15 is stopped by the stopper 18. Therefore, it is possible to accurately detect malfunctions due to interruption of the driving linkage between the actuator 10 and the second valve shaft 15 (stopper 18), for example the malfunctions 1) to 4).

6) According to the embodiment of the invention, a hall element sensor, which detects the rotation amount with the use of the hall element 29, is used as the sensor 19 that detects the amount by which the first valve shaft 11 is rotated by the actuator 10. Therefore, it is possible to easily and accurately detect the amount by which the first valve shaft 11 is rotated by the actuator 10.

7) The embodiment of the invention relates to the intake airflow control mechanism that is provided in the V-engine and that is structured in such a manner that the first valve shaft 11 is provided at one of the banks of the V-engine and the second valve shaft 15 is provided at the other bank. In the V-engine, because some cylinders are formed in the right bank and the other cylinders are formed in the left bank, each of the banks needs to be provided with the valve shaft for the intake airflow control valves. According to the embodiment of the invention, even in the intake airflow control mechanism that is employed in the V-engine, it is possible to accurately detect a malfunction with the use of only the sensor 19 that is provided near the actuator 10.

Figure 3:
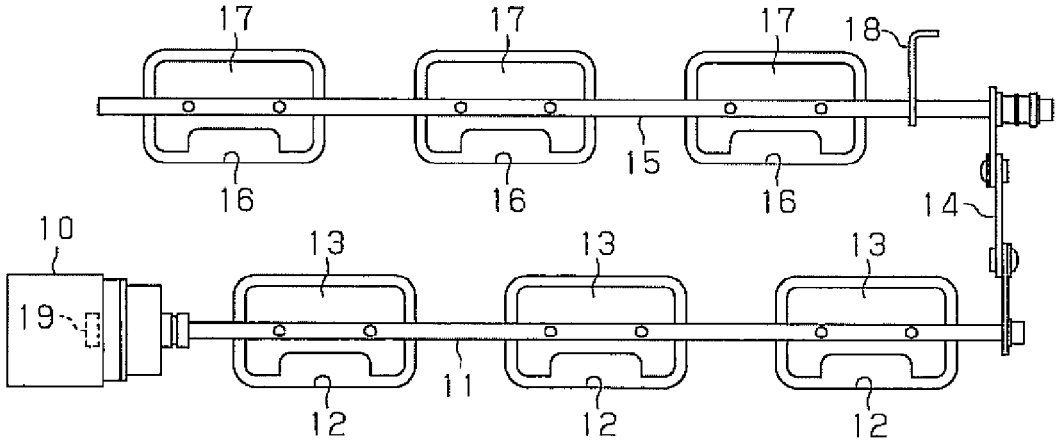
FIG. 3 is a view schematically showing the overall structure of an intake airflow control mechanism for an engine according to a modification of the embodiment of the invention.

The embodiment of the invention may be modified as follows. In the embodiment of the invention described above, the stopper 18 is provided at the end of the second valve shaft 15, the end being on the opposite side of the end of the second valve shaft 15, to which the link mechanism 14 is connected. If there is no concern that the second valve shaft 15 breaks at its middle portion, it is possible to accurately detect a malfunction regardless of where on the second valve shaft 15 the stopper 18 is provided. For example, in an example of the structure of an intake airflow control mechanism for an engine according to a modification of the embodiment of the invention shown in FIG. 3, the stopper 18 is provided at the base end of the second valve shaft 15, that is, the end of the second valve shaft 15, which is connected to the link mechanism 14.

Figure 4:
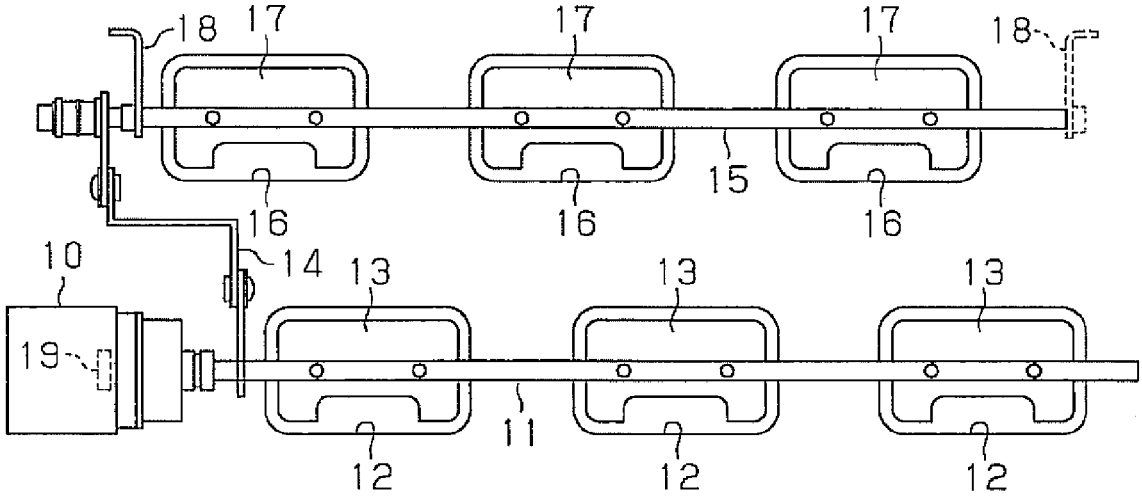
FIG. 4 is a view schematically showing the overall structure of an intake airflow control mechanism for an engine according to another modification of the embodiment of the invention.
Figure 5:
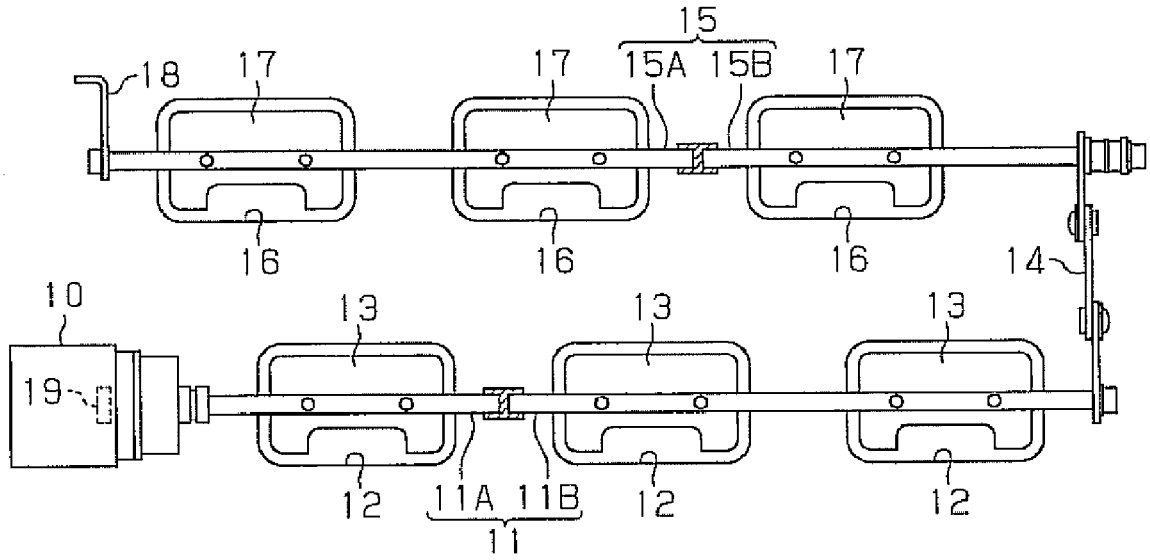
FIG. 5 is a view schematically showing the overall structure of an intake airflow control mechanism for an engine according to yet another modification of the embodiment of the invention.
Figure 6:
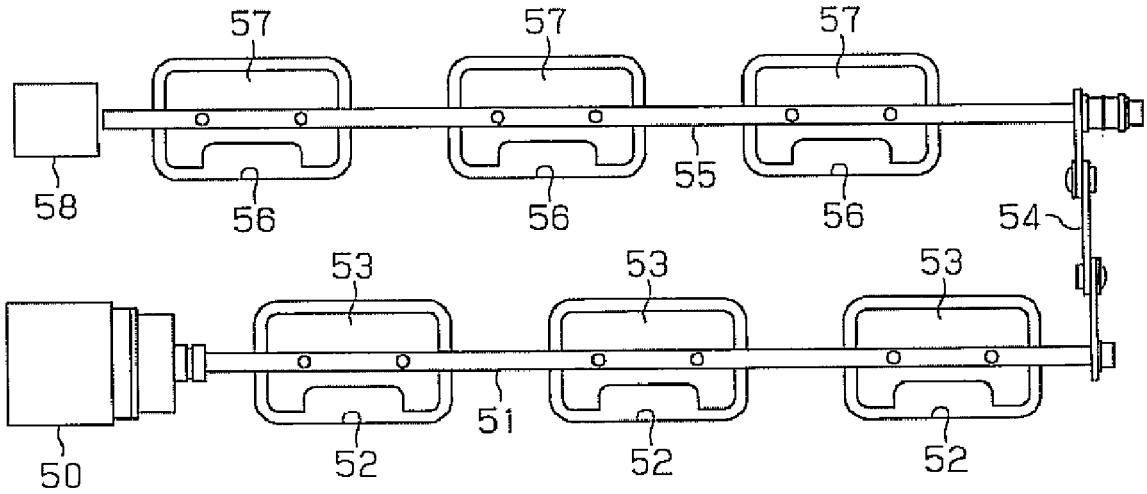
FIG. 6 is a view schematically showing the overall structure of an existing intake airflow control mechanism mounted in a V-engine.

According to the embodiment of the invention described above, the tip end of the first valve shaft 11, that is, the end of the first valve shaft 11, which is on the opposite side of the actuator 10, is connected to the second valve shaft 15 via the link mechanism 14. The manner in which the first valve shaft 11 and the second valve shaft 15 are connected to each other may be changed as required. For example, in an example of the structure of an intake airflow control mechanism for an engine according to another modification of the embodiment of the invention shown in FIG. 4, the base end of the first valve shaft 11, that is, the end of the first valve shaft 11, which is on the side of the actuator 10, is connected to the second valve shaft 15 via the link mechanism 14. In the intake airflow control mechanism that includes the link mechanism 14 which transmits the rotation of the first valve shaft 11 to the second valve shaft 15, if there are provided the stopper 18 that stops the rotation of the second valve shaft 15 when the second valve shaft 15 is in a prescribed rotational position and the sensor 19 that detects the amount by which the first valve shaft 11 is rotated by the actuator 10, it is possible to accurately detect a malfunction and to provide the actuator 10 and the sensor 19 at appropriate locations. In this case, the stopper 18 may be provided at the end of the second valve shaft 15, which is on the side of the link mechanism 14, as indicated by a solid line in FIG. 4 or at the end of the second valve shaft 15, which is on the opposite side of the link mechanism 14, as indicated by a dashed line. The stopper 18 may be provided on the second valve shaft 15 at a position other than the ends.

According to the embodiment of the invention described above, each of the first valve shaft 11 and the second valve shaft 15 is formed of a single shaft member. Alternatively, each of the first valve shaft 11 and the second valve shaft 15 may be formed by connecting multiple shaft members to each other. For example, in an example of the structure of an intake airflow control mechanism for an engine according to yet another modification of the embodiment of the invention, the first valve shaft 11 is formed by connecting two shaft members 11A and 11B to each other, and the second valve shaft 15 is formed by connecting two shaft members 15A and 15B to each other. In this case, a malfunction due to breakage of a portion at which the shaft members are connected to each other may occur. However, if the stopper 18 is provided at an appropriate position, more specifically, if the stopper 18 is provided on the shaft member at a position that is at the downmost stream of the path through which the power from the actuator 10 is transmitted, such a malfunction may be detected.

According to the embodiment of the invention described above, the hall element sensor is employed as the sensor 19 that detects the amount by which the first valve shaft 11 is rotated by the actuator 10. However, other types of sensors that detect the rotation amount may be employed.

According to the embodiment of the invention described above, the sensor 19 that detects the amount by which the first valve shaft 11 is rotated by the actuator 10 is embedded in the actuator 10. Alternatively, the sensor 19 may be provided outside the actuator 10. In this case, the sensor 19 that detects the rotation amount may be provided near the actuator 10. Therefore, it is possible to accurately detect a malfunction and to provide the actuator 10 and the sensor 19 at appropriate locations.

According to the embodiment of the invention described above, the actuator 10 uses the motor 21 as the power source for opening and closing the intake airflow control valves. Alternatively, an actuator that uses another type of a power source may be employed. For example, a negative-pressure actuator that opens and doses the intake airflow control valves using a negative pressure generated in an intake passage of the engine may be employed instead of the actuator 10.

In the embodiment of the invention described above, the intake airflow control mechanism according to the invention is applied to a V-six engine. However, the invention may be applied to intake airflow control mechanisms that are used in other types of engines such as V-engines in which the number of cylinders is other than six and engines other than V-type. In this case, the number and arrangement of valve shafts and the number of valves provided on each valve shaft may be changed as required based on the configuration of the intake ports of the engine. The invention may be applied to any types of intake airflow control mechanisms that include multiple valve shafts that are connected via a linkage mechanism in such a manner that the valve shafts are driven together with each other.

What is claimed is:

1. An intake airflow control mechanism for an engine, comprising:

a first valve shaft and a second valve shaft on which respective valve elements of intake airflow control valves are fitted in such a manner that the valve elements pivot in accordance with rotation of the first valve shaft and the second valve shaft;

an actuator that rotates the first valve shaft;

a link mechanism that transmits the rotation of the first valve shaft to the second valve shaft;

a stopper that stops the rotation of the second valve shaft in a prescribed rotational position; and a sensor that detects an amount by which the first valve shaft is rotated by the actuator, wherein the stopper is provided at an end of the second valve shaft, the end being on an opposite side of an end of the second valve shaft, to which the link mechanism is connected.

2. The intake airflow control mechanism for an engine according to claim 1, wherein the sensor is embedded in the actuator.

3. The intake airflow control mechanism for an engine according to claim 1, wherein the stopper stops the rotation of the second valve shaft in both a rotational position in which the valve element is fully opened and a rotational position in which the valve element is fully closed.

4. The intake airflow control mechanism for an engine according to claim 1, wherein the sensor is a hall element sensor that detects the amount of rotation with use of a hall element.

5. The intake airflow control mechanism for an engine according to claim 1, wherein:

the intake airflow control mechanism is provided in a V-engine;

the first valve shaft is provided at one of banks of the V-engine; and the second valve shaft is provided at the other bank of the V-engine.

6. An intake airflow control mechanism for an engine, comprising:

a first valve shaft and a second valve shaft on which respective valve elements of intake airflow control valves are fitted in such a manner that the valve elements pivot in accordance with rotation of the first valve shaft and the second valve shaft;

an actuator that rotates the first valve shaft;

a link mechanism that transmits the rotation of the first valve shaft to the second valve shaft;

a stopper that stops the rotation of the second valve shaft in a prescribed rotational position;

a sensor that detects an amount by which the first valve shaft is rotated by the actuator; and a malfunction detection unit that determines that a malfunction has occurred in the intake airflow control mechanism, when the first valve shaft is continuously rotated by the actuator even after the amount by which the first valve shaft is rotated by the actuator, the amount being detected by the sensor, exceeds an amount of rotation that is required to rotate the second valve shaft to the rotational position in which the rotation of the second valve shaft is stopped by the stopper.

7. The intake airflow control mechanism for an engine according to claim 6, wherein the sensor is embedded in the actuator.

8. The intake airflow control mechanism for an engine according to claim 6, wherein the stopper stops the rotation of the second valve shaft in both a rotational position in which the valve element is fully opened and a rotational position in which the valve element is fully closed.

9. The intake airflow control mechanism for an engine according to claim 6, wherein the sensor is a hall element sensor that detects the amount of rotation with use of a hall element.

10. The intake airflow control mechanism for an engine according to claim 6, wherein:

the intake airflow control mechanism is provided in a V-engine;

the first valve shaft is provided at one of banks of the V-engine; and the second valve shaft is provided at the other bank of the V-engine.

* * * * *

UNITED STATES PATENT AND TRADEMARK OFFICE

CERTIFICATE OF CORRECTION

PATENT NO. : 7,814,876 B2
APPLICATION NO. : 12/413781
DATED : October 19, 2010
INVENTOR(S) : Akira Nakawatase It is certified that error appears in the above-identified patent and that said Letters Patent is hereby corrected as shown below:

Column 5, Line 14 - delete “it” and insert --11--
Column 10, Line 4 - delete “doses” and insert --closes--

Signed and Sealed this
Twenty-second Day of February, 2011

David J. Kappos

David J. Kappos
*Director of the United States Patent and Trademark Office*